United States Patent [19]

Woodson

[11] 4,153,255

[45] May 8, 1979

[54] PUTTER TRAINING DEVICE

[76] Inventor: Leland B. Woodson, 108 W. 12th, Hutchinson, Kans. 67501

[21] Appl. No.: 741,629

[22] Filed: Nov. 15, 1976

[51] Int. Cl.[2] ..... A63B 69/36

[52] U.S. Cl. ..... 273/186 A; 273/186 C; 273/192

[58] Field of Search ..... 273/192, 191 R, 191 A, 273/191 B, 194, 193, 186 R, 186 A, 186 C

[56] References Cited

U.S. PATENT DOCUMENTS

| | | | |
|---|---|---|---|
| 1,536,512 | 5/1925 | McLaren | 273/192 X |
| 2,084,902 | 6/1937 | Eisenberg | 273/192 |
| 2,340,793 | 2/1944 | Chapman | 273/192 |
| 3,310,306 | 3/1967 | Burt | 273/58 C X |
| 3,415,523 | 12/1968 | Boldt | 273/191 R X |
| 3,806,133 | 4/1974 | Cork | 273/192 |

FOREIGN PATENT DOCUMENTS

| | | | |
|---|---|---|---|
| 1063586 | 3/1967 | United Kingdom | 273/186 C |

*Primary Examiner*—George J. Marlo
*Attorney, Agent, or Firm*—Robert E. Breidenthal

[57] ABSTRACT

Apparatus for improving a golfer's putting stroke including a pair of parallel, spring tensioned flexible cables mounted in spaced relation above a horizontal platform constituting a putting surface and on opposite sides of the resting site of the golf ball. The head of the putter is provided with grooves that slidingly receive the cables, or a guide attachment is detachably secured to the putter head that has guided sliding engagement with the cables.

10 Claims, 9 Drawing Figures

FIG. 3
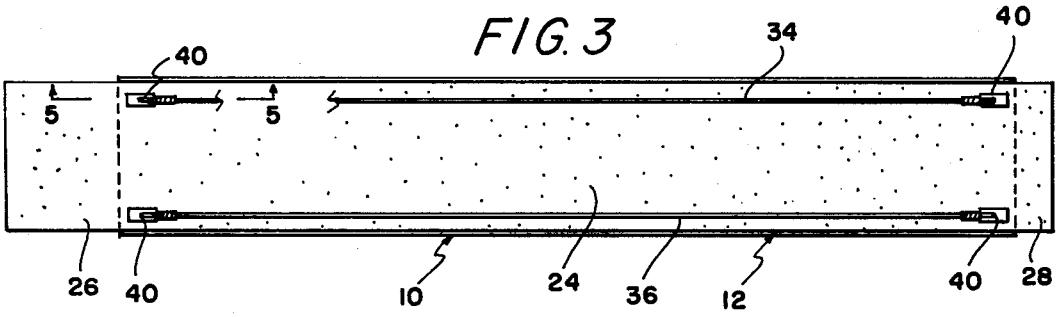
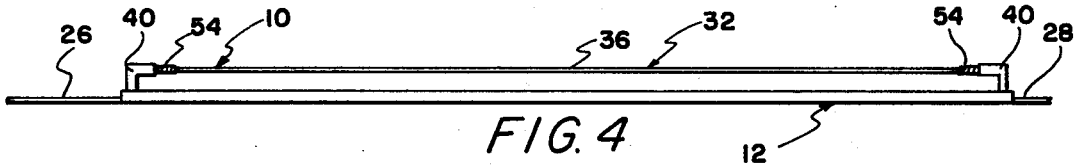
FIG. 4
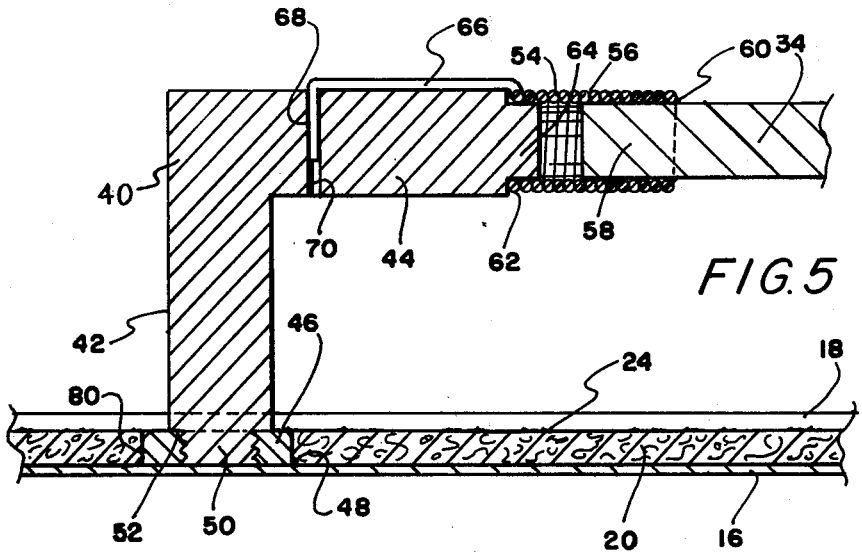
FIG. 5
FIG. 6
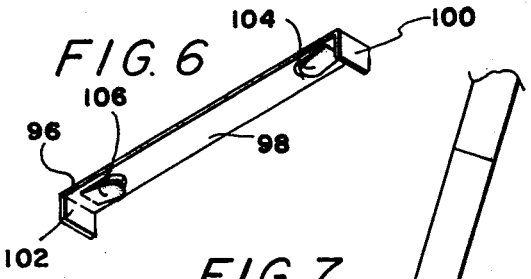
FIG. 7
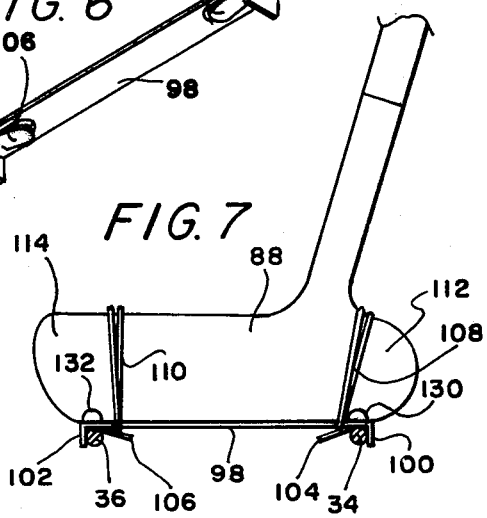
FIG. 8
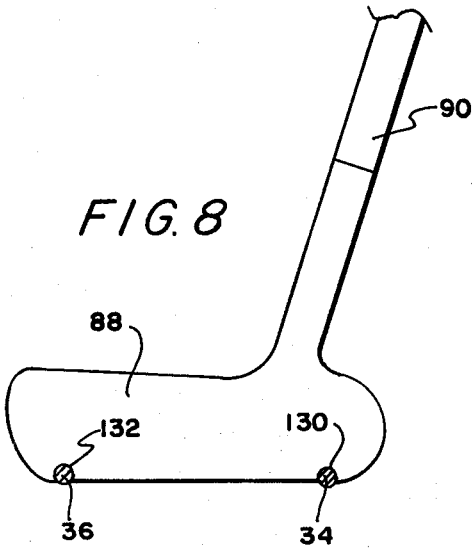

PUTTER TRAINING DEVICE

The present invention relates to new and useful improvements in training aids for golfers, and pertains more particularly to a device for enabling a golfer within his home or yard or at his office to stabilize and perfect his golfing stroke.

Numerous devices have heretofore been proposed for enabling golfers to improve their swing and/or stroke, and these have included devices having the objective of improving the putting game. Each of these devices have seemingly been found wanting in one or more particulars, such as apprising a golfer of his error after the fact rather than during its commission, or of forcing putter head movement in such an inflexible manner that even if the movement is perfect, the golfer is deprived of developing a "feel" for correct and natural hands, arms and body movement, and may develop an unfortunate insensitivity to the proper performance of the ball stroking act.

It is the primary object of the present invention to provide a putter training aid usable in a limited space indoors or outdoors that will enable a golfer to acquire a "feel" for correct stroking by causing yielding forces against the putter head when the path is improper or when the face of the putter head departs from being perpendicular in the horizontal plane to the path.

Another object is to provide a training aid in accordance with the foregoing object that can employ a specially modified putter head, or alternatively can employ an attachment that can be detachably secured to the putter head.

Still another object of the invention is to provide a training aid of the character set forth above which can be readily disassembled for compact storage or shipping.

A final object to be specifically set forth is to provide a device of the character above specified which will be durable and inexpensive and which will beneficially effect the user shortly after commencing to use the same.

A broad aspect of the invention involves a training aid for golfers for improving their putting stroke by urging linearity of movement of the putter head as it moves to contact a golf ball, said aid comprising a green simulating means defining a horizontal putting surface, and the provision of coacting first and second guide means respectively adapted to be carried by a putter head and mounted on the green simulating means, said second guide means including an elongated element slidingly engageable by the first guide means and operative during such sliding engagement to yieldingly oppose departure of the first guide means from a path having a straight projection on a horizontal plane.

A somewhat more limited aspect of the invention involves a training aid for golfers comprising a green simulating means presenting a horizontal putting surface, a guide means including a pair of elongated elements disposed in spaced parallelism above the putting surface, said elements being laterally movable from positions of repose thereof with said guide means including resilient means yieldingly opposing lateral movement of the elements for restoring the elements to their positions of repose, said guide means including a coacting guide means slidably and guidingly engageable with the guide elements for urging a putter head to travel a preselected putting stroke.

Other objects as well as various features and advantages of the invention will become evident in the light of the following description of a preferred embodiment of the drawingss, the same being given in conjunction with the accompanying drawings illustrative thereof, wherein:

FIG. 3 is a top view of the training aid;

FIG. 4 is a side elevation of the training aid;

FIG. 5 is an enlarged sectional detail view taken upon the vertical plane at the section line 5—5 in FIG. 3;

FIG. 6 is an isometric view of the underside of the guide clip attachment, and FIG. 7 shows such clip detachably secured to the head of a fragmentarily shown putter, with the guide elements being shown in section in operative association with the guide clip;

FIG. 8 shows the putter head as having optional grooves that can operatively receive the elongated guide elements (shown in section) in lieu of the guide clip; and, FIG. 9 is an enlarged isometric view of one of the mounting posts.

Figure 1:
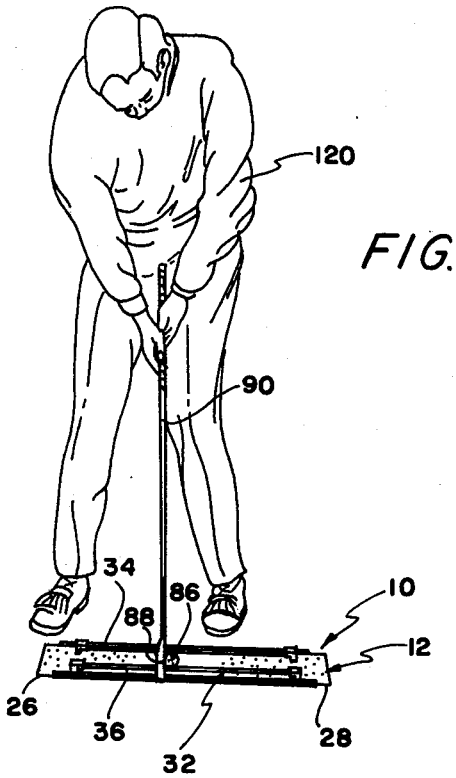
FIG. 1 is a frontal perspective view of a golfer using the training aid of the invention.

Referring now to the drawings wherein like numerals designate like parts throughout the various views, the reference numeral 10 designates the training aid generally, the same being comprised of a base 12 which may conveniently be in the form of a shallow steel channel member 14 constituted of an elongated flat web 16 having integral short upstanding side flanges 18.

The base 12 also includes a thin and flexible sheet or pad 20 having a matted or carpet-like surface or nap 24, such pad 20 overlying the web 16 and being fitted between the flanges 18. The pad 20 projects as extensions 26 and 28 for short intervals beyond the opposite ends of the web 16 so as the rest upon and merge and conform well with any support surface 30 which the base 12 may be placed. The pad 20 can be cemented or in any other suitable manner be secured to the member 14 so as to be secure thereon, particularly as against endwise movement thereon, however this is unnecessary as will be evident presently.

The training aid or device 10 is provided with a guide means designated generally at 32 that comprises a pair of elongated flexible elements 34 and 36 preferably in the form of small diameter wire, rope or cable such as those commonly used as aircraft control cables of stainless steel.

The guide elements 34 and 36 are resiliently mounted under tension in spaced parallelism to each other and in spaced parallelism above the surface 24.

Figure 9:
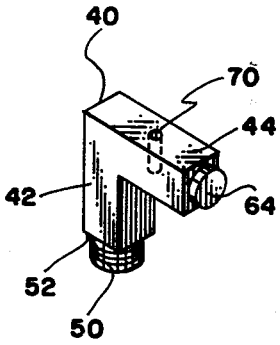
Figure 2:
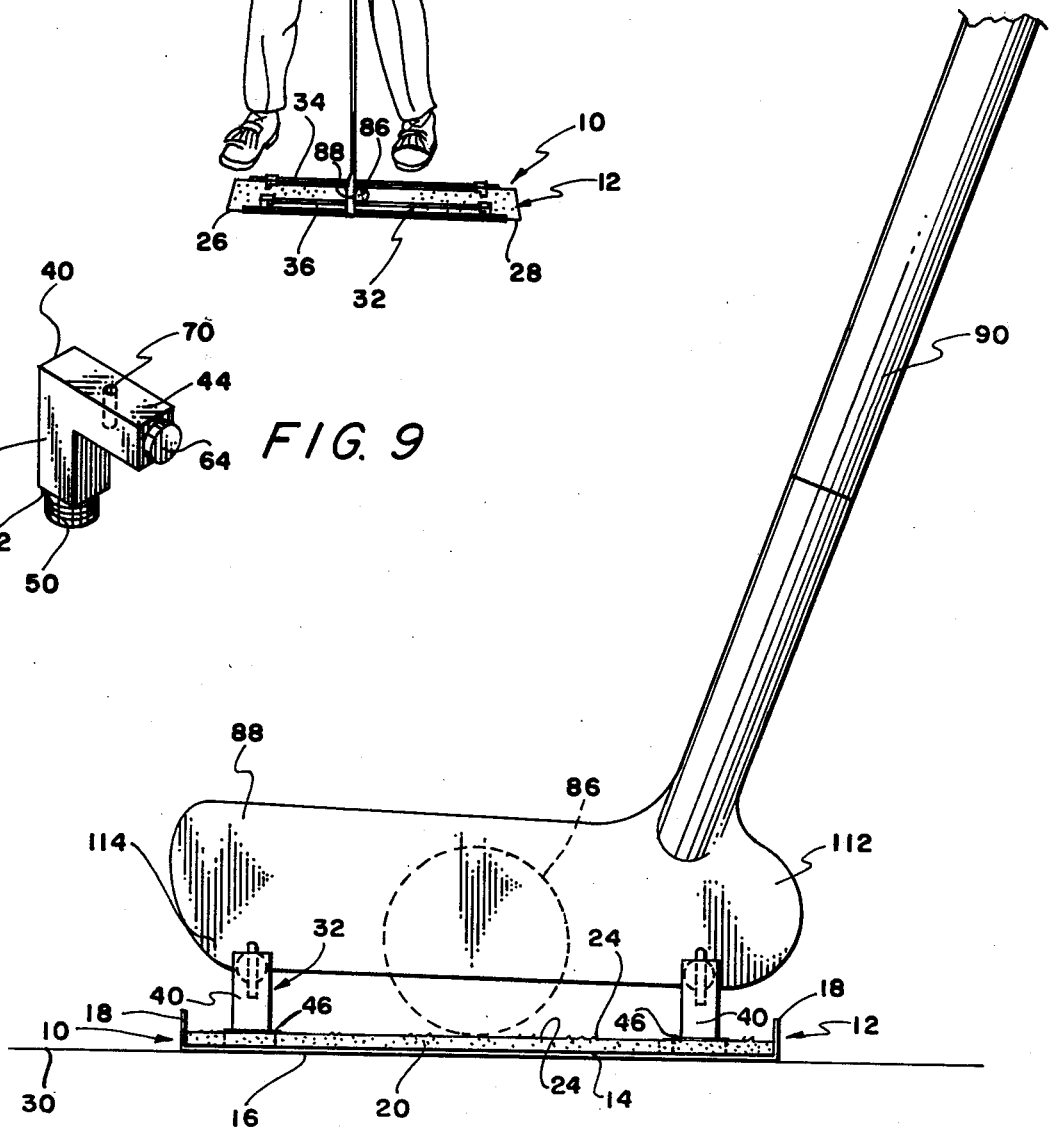
FIG. 2 is an enlarged end view of the training aid, this view fragmentarily showing the putter and showing a golf ball in dashed outline.

The mounting of the elements 34 and 36 comprises identical means at both ends of each of the elements 34 and 36 and a detailed description of one of such four mounting provisions will suffice for all, and attention is directed primarily to FIGS. 2, 5 and 9 for an appreciation thereof.

An L-shaped post 40 having integral vertical and horizontal legs 42 and 44 is detachably secured to the web 14 by means of an internally threaded nut 46 spot welded or brazed (as at 48) to the latter. The lower end 50 of the leg 42 is reduced and threaded to mate with the nut 46, and to define a shoulder 52. The nut 46 and the post 40 are preferably oriented relative to the base 12 so that the leg 44 is directed in the direction of the extent of the element or cable 34 when the post 40 is screwed tightly into the nut 46 to its limit such as can optionally be limited by the shoulder 52 being forced to seat against the nut 46 or the lowest extremity of the end portion 50 being forced to seat against the web 16.

The desired relationship can be readily effected by threading the end portion 50 into the nut 46 to seat the shoulder 52 against the nut 46, and then spot welding the nut 46 to the web 16 when the post 40 is disposed in its desired orientation. Those skilled in the art will take such precautions as may be necessary to avoid welding the post 40 directly to the nut 46 or the web 16, such as having the portion 50 of less length than the depth of the nut 46.

A coiled tension spring 54 has an end portion 56 which receives and is securely fastened to an end portion 58 by epoxy glue or by brazing as at 60. The other end portion 62 of the spring 54 embraces a circular reduced extremity 64 of the post leg 44 and is releasably retained thereon by means of an integral end portion of the wire of which the spring 54 is wound being bent to extend along the top of the leg 44 as shown at 66. The resilient wire 66 terminates in an end portion 68 bent at right angles thereto so as to project into a transverse and vertical opening 70 in the post leg 44. The arrangement is such that the resiliency of the spring wire 66 tends to retain the end portion 68 in the opening, but if desired, the portion 66 can be caused to resiliently flex to release the spring 54 from the post 40.

In the light of the foregoing, the post 40 is threadingly attached to the channel member 14 and the cable 34 is thereafter attached to the post 40 by means of the spring 54 at its end.

The detachability of the posts 40 from both the channel member 14 and the cables 34 and 36 facilitates compact storage and packaging as will be understood as well as permitting the replacement of parts rather than an entire device in the event of breakage.

As mentioned previously, the pad 20 need not be glued to the channel member 14. This is for the reason that the pad 20 is provided with four openings 80 positioned and sized to accommodate the nuts 46 as shown in FIG. 5. The interlocking thereby obtained will prevent endwise movement of the pad 20, while permitting separate replacement of the pad 20 in the event of the need therefor. The channel member 14 and the pad 20, as should be evident, jointly define means simulating a green surface for supporting a golf ball 86 in position for application of a putting stroke thereto by the head 88 of a putter 90.

The guide means 32 constituted of the yieldingly tensioned and supported cables 34 and 36 additionally includes coacting guide means movable with the putter head 88. Such coacting guide means is comprised of a guide clip 96 in the form of a channel-shaped member constituted of an elongated web 98 having integral depending flanges 100 and 102 at its opposite ends. The web 98 has integral facing tabs 104 and 106 (which can be formed by making U-shaped slits in the web 98 and down striking included material), whereby elastomeric or rubber bands 108 and 110, which are placed to embrace the web and respectively the heel and toe portions 112 and 114 of the putter head 88, are retained from movement toward the flanges 100 and 102.

The guide clip 96 when detachably secured to the putter head 88 by the rubber bands 108 and 110 as described and shown in FIG. 7 holds the clip 96 snugly against the underside of the putter head 88. Such holding can and is preferably augmented by the guide clip 96 being made of thin spring steel material, and by having the web 98 thereof being slightly arched or convex upwardly between the tabs 104 and 106 when in repose so as to resiliently bear against the underside of the putter head 88 when secured thereto by the rubber bands 108 and 110. The spring strength of the web 98 is weak relative to the strength of the rubber bands 108 and 110 so that the web 98 is flexed to seat flush against the underside of the putter head 88.

The spacing of the flanges 100 and 102 is such as to accommodate the cables 34 and 36 therebetween as shown in FIG. 7.

The use of the training aid 10 will be readily understood.

The user 120 of the device 10 places the ball 86 on the surface 24 intermediate the cables 34 and 36 and addresses the ball 86 taking his stance while gripping the putter 90 as shown in FIG. 1. Such positioning is accomplished with the cables 34 and 36 being slidingly received against the web 98 and respectively against the flanges 100 and 102.

The golfer or user 120 then moves his arms and the putter 90 back and forth several times preparatory to actually impacting the ball 86.

During such preliminary movements, the cables 34 and 36 will coact with the guide clip 96 to yieldingly oppose (a) any departure of the putter head 88 from a path having a straight projection in the horizontal plane, and (b) any twisting of the putter 90 such as to move the face 122 of the putter head from being perpendicular in the horizontal plane to the aforementioned path (as this would require the flanges 100 and 102 to urge the cables 34 and 36 toward each other).

It is important to note that the guiding effects of (a) and (b) above are not such as to prevent such departures as are opposed, but to yieldingly oppose by applying guiding forces that increase in magnitude in proportion to the magnitude of the departure.

Such variation in the magnitude of forces with magnitude of error or departure enables a beneficial learning process facilitating what may be termed a live feel that is believed substantially superior to the relatively deadening effect of simply compelling, without deviation, the proper movement of the putter head. Such might be appreciated on considering how efficiently a railroad engineer could learn during countless miles of following trackage the art of steering a dirigible vehicle. The learning process is enhanced by bringing about an active interplay of the nervous sensing system and the application of corrective muscular forces.

In addition to the foregoing, the user 120 can learn the proper variation in vertical forces during his putting stroke by repetitiously stroking while scrupulously maintaining his head height invariant. On becoming accustomed or attuned to such proper force variation, departures will be recognized and corrected. In any event, the mounting of the elements 34 and 36 will accommodate such vertical variation that will occur if the putter head 88 travels along a vertical height.

Of course, the vertical guidance is such that it would, if desired, enable the user to develop a stroke such that the putter head 88 would not move vertically during the stroke; this being accomplished by developing a stroke such that the vertical force becomes invariant.

The guide clip 96 enables the user to use the device 10 in association with his favorite putter without modification of the latter, it being noted that one desideratum of the clip 96 is that it have little weight. However, the user might be willing to modify his putter to the extent of modifying the same to include a pair of grooves 130 and 132 in its underside of such depth and spacing as to slidingly and guidingly accommodate the cables 34 and 36, respectively, or the user may be willing to undertake the expense of such a specially modified putter as a part of the cost of a complete training aid 10 in order to avoid the normally insignificant nuisance of applying and removing the clip 96, or any possible mental hangup over the presence of the clip 96.

FIG. 8 illustrates the coaction of the grooves 130 and 132 with the cables 34 and 36. That such coaction will be essentially identical to that between the guide clip 96 and the cables 34 and 36 will be evident on comparing the grooves 130 and 132 with the functionally corresponding parts of the guide clip 96 in FIG. 7 where the latter is applied to a putter head having such grooves therein.

The use of a putter head having grooves therein or of a clip 96 is substantially a matter of choice largely dictated by economics; however, maximum convenience, perfectly consistent putter head weight in training and actual use, and absence of any mental hangups dictate a preference for the use of a grooved putter head in lieu of the detachable clip 96.

Whatever the form of the movable coacting guide means, the use of the training aid is the same, and after the preliminary back and forth movements previously described, the ball is actually stroked and the guiding means will serve during the stroke and during the follow-through any departure from the desired putter head path. In some respects the greatest benefit flowing from the use of the aid is the "live" signaling to the user any departures during the actual stroke and especially the follow-through portion of the latter. The device 10 serves at such critical time to apprise the user of any failure in his attentiveness and concentration that must be rigorously maintained to the very end of any putting effort.

The invention having been described sufficiently to enable its practice and beneficial use by those of only limited skill in the art, attention is now directed to the appended claims in order to ascertain the actual scope of the invention.

I claim:

1. A training aid for golfers for improving their putting stroke by urging linearity of movement of the putter head in the vertical plane as it moves to contact a golf ball, said aid comprising a green simulating means defining a horizontal putting surface, and the provision of coacting first and second guide means respectively adapted to be carried by a putter head and mounted on the green simulating means, said second guide means including an elongated and flexible guide element of substantially cylindrical transverse section, spaced support means secured to the green simulating means for supporting the opposite ends of said element with the latter extending freely therebetween in spaced relation above the putting surface, resilient means for yieldingly maintaining said element under tension in its extent between the support means, said element being slidingly engageable by the first guide means and operative during such sliding engagement to yieldingly oppose departure of the first guide means from a path having a straight projection on a horizontal plane.

2. The combination of claim 1, wherein said second guide means also, during sliding engagement by the first guide means, yieldingly opposes downward movement of the first guide means relative to a horizontal plane.

3. The combination of claim 1, wherein the elongated element has its opposite ends connected to the spaced support means, with the connection of the element to the support means including a spring constituting said resilient means.

4. The combination of claim 1, including a putter head, with said first guide means including said putter head having a groove in its lower edge when disposed in its position of use for slidingly and guidingly receiving the elongated element of the second guide means therein.

5. A training aid for golfers comprising a green simulating means presenting a horizontal putting surface, a guide means including a pair of elongated and flexible guide elements horizontally disposed in horizontally spaced parallelism to each other and spaced above the putting surface, resilient means secured to the green simulating means and connected to the extremities of the elements for supporting and maintaining the latter under tension whereby the elements yieldingly oppose lateral displacement vertically and horizontally from a normal position of repose to which position the elements are restored on removal of any displacing force, and said guide means also including a coacting guide means slidably and guidingly engageable with the guide elements for urging a putter head to travel a preselected putting stroke.

6. The combination of claim 6, including a putter head, with said coacting guide means comprising the putter head having a pair of grooves in its lower edge when disposed in its position of use slidably receiving the elongated guide elements.

7. The combination of claim 6, including means for detachably securing the coacting guide means to a putter head and wherein said coacting guide means is a U-shaped member that includes an elongated web connecting depending flanges that have a spacing about the same as that of the elongated elements for receiving the latter therebetween, and wherein said detachably securing means includes an element adapted to embrace a putter head.

8. The combination of claim 5, wherein said resilient means includes in association with each of said elongated elements a pair of upstanding posts secured to the green simulating means, with coiled tension springs connecting the opposite extremities of the elongated element to the posts.

9. The combination of claim 8, wherein the posts are detachably secured to the green simulating means by threaded fastening means.

10. The combination of claim 8, wherein the posts are L-shaped and include a vertical leg having an integral horizontal leg at its top, each of said coiled tension springs having one end embracing an extremity of an elongated element and its other end embracing an extremity of the horizontal leg of one of the posts.

* * * * *